US005873551A

United States Patent [19]

Jones

[11] Patent Number: 5,873,551

[45] Date of Patent: Feb. 23, 1999

[54] BABY BOTTLE HOLDER

[76] Inventor: Philip J. Jones, 27 Clark St., #2, Brattleboro, Vt. 05301

[21] Appl. No.: 814,509

[22] Filed: Mar. 10, 1997

Related U.S. Application Data

[60] Provisional application No. 60/014,727 Mar. 20, 1996.

[51] Int. Cl.[6] ..... A47D 15/00

[52] U.S. Cl. ..... 248/102; 224/600; 248/104

[58] Field of Search ..... 248/102, 104, 248/205.2, 103; 2/49.2; 224/600, 602

[56] References Cited

U.S. PATENT DOCUMENTS

| | | | |
|---|---|---|---|
| 1,136,529 | 4/1915 | Hopwood | 248/102 |
| 1,281,948 | 10/1918 | Guiterman | 248/102 |
| 2,462,187 | 2/1949 | Helixon | 248/102 X |
| 2,490,207 | 12/1949 | Cassile | 248/102 |
| 2,494,632 | 1/1950 | Rodin . | |
| 2,617,105 | 11/1952 | Backman . | |
| 2,644,623 | 7/1953 | White . | |
| 3,065,944 | 11/1962 | Liebendorfer . | |
| 3,144,230 | 8/1964 | Brooks . | |
| 3,197,099 | 7/1965 | Doba . | |
| 4,096,977 | 6/1978 | Barville . | |
| 4,220,302 | 9/1980 | Hampton . | |
| 4,498,613 | 2/1985 | Donahue et al. | 248/102 X |
| 4,564,957 | 1/1986 | Scharf | 248/102 X |
| 4,718,623 | 1/1988 | McClure | 248/102 |
| 5,242,063 | 9/1993 | Ericksen et al. | 248/205.2 X |

*Primary Examiner*—Derek J. Berger
*Attorney, Agent, or Firm*—Richard C. Litman

[57] ABSTRACT

A baby bottle holder provides for the hands free holding of a baby bottle for bottle feeding an infant, thus enabling the person caring for the infant to have both hands free for holding the infant and/or performing other duties as required. The holder comprises several embodiments, each of which has a neck sling removably securable about the neck of the user and a bottle securing strap which secures removably about the neck of the baby bottle adjacent the nipple end of the bottle. Some embodiments comprise a pliable sleeve having a conical section with all diameters greater than that of the bottle, with the bottle being placed in the sleeve with the nipple end toward the larger diameter portion of the sleeve. The nipple of the bottle thus extends downwardly for feeding the infant, with the bottle being secured by the bottle securing strap. The bottle is easily tilted upwardly to preclude leakage from the nipple when not in use, by everting the sleeve over the upper end of the bottle. Other embodiments utilize an elastic strap for the sleeve portion, with a pliable connecting sheet or strap between the sleeve and the bottle securing strap. The bottle may be positioned with the nipple upward by sliding the elastic sleeve toward the nipple end of the bottle, thus positioning the center of gravity of the bottle beyond the sleeve. Each embodiment allows the user to position the bottle easily either nipple downward or nipple upward, as desired.

2 Claims, 7 Drawing Sheets

BABY BOTTLE HOLDER

REFERENCE TO RELATED PATENT APPLICATION

This application claims the benefit of U.S. Provisional Pat. application Ser. No. 60/014,727, filed on Mar. 20, 1996.

BACKGROUND OF THE INVENTION

1. Field of the Invention

The present invention relates generally to supports, straps, and slings providing for the support, carriage, or holding of an article and supported by a person, and more specifically to a baby bottle holder which provides for the hands free support of a baby bottle by an adult, for feeding an infant. The present baby bottle holder includes an adjustable neck sling which secures about the neck of the person holding the baby, with the sling supporting a bottle holder portion which secures around the bottle and automatically suspends the bottle in a nipple downward orientation. The bottle holder portion may be everted or moved relative to the bottle, to reposition the bottle therein to suspend the bottle with the nipple upward when the bottle is not in use. A doubled over band of hook and loop fastener material is used to secure the sleeve or holder portion to the bottle adjacent the nipple end of the bottle.

2. Description of the Prior Art

Being the parent of a small infant is a demanding task, and it often seems that the parent or guardian has neither sufficient time nor hands to do an adequate job. This can be particularly true at meal times for the infant, when the adult must cradle the child, hold the bottle, and perhaps perform other chores simultaneously, such as wiping up spills, answering a telephone, etc.

Thus, the need for some means of holding a baby bottle to provide for hands free feeding of an infant, has long been recognized. However, none of the devices known are capable of automatically supporting the bottle at the proper angle for feeding the infant, while also allowing the holder to be adjusted to support the bottle with the nipple raised, to preclude dripping or spillage from the tip of the nipple when the bottle is not in use. A discussion of the prior art known to the present inventor, and its differences from the present invention, is provided below.

U.S. Pat. No. 2,494,632 issued on Jan. 17, 1950 to Robert Rodin describes a Nursing Bottle Holder, comprising a fabric pouch which completely and tightly surrounds the bottle, except for the nipple end. A strap is secured to two separated points on the pouch to support it and a bottle contained therein. Elastic is used at the neck of the bottle, adjacent the nipple end, to secure the pouch around the bottle. The bottle is thus immovably installed within the pouch during use, and the only means of tilting the angle of the bottle, is by adjusting the position of the strap about the user's neck.

U.S. Pat. No. 2,617,105 issued on Nov. 11, 1952 to Frances G. Backman describes an Article For Protecting Clothing, comprising an elongate flat sheet of absorbent material which is sewn together longitudinally at each end, to form a bottle pocket at each end. The device is adapted for use only as a bottle storage means and burping cloth, and not as a device for holding a bottle during the actual feeding process. The device is slung diagonally over a shoulder, rather than being suspended about the neck. Thus, a bottle held in one of the pockets thereof will be supported with the nipple upward, and cannot be used to hold the bottle for feeding, as provided by the present bottle holder.

U.S. Pat. No. 2,644,623 issued on Jul. 7, 1953 to Gwendolyn S. White describes a Nursing Bottle Holder, comprising a sling with a neck strap secured thereto. One end of the strap extends downwardly into the sling, to form a loop therein. A baby bottle is inserted into the sling through one end thereof, and the base end of the bottle may be suspended within the strap loop within the sling to position the nipple end of the bottle downwardly for feeding. When the feeding has been completed, the base of the bottle is removed from the strap loop within the sling, and allowed to rest within the sling. However, even when the bottle is resting within the sling, the nipple end of the bottle is angled slightly downwardly (col. 4, lines 73—75), thus allowing a bottle even slightly less than half full to drip from the nipple. No means of everting or adjusting the sling to raise the nipple end of the bottle is provided by White, as is provided by the present invention.

U.S. Pat. No. 3,065,944 issued on Nov. 27, 1962 to Georgia R. Liebendorfer describes a Nursing Bottle Holder, comprising a sleeve with an elastic insert which grips the bottle tightly. A neck strap extends from the sleeve. Adjustment of the bottle angle is provided by tying a loop in the strap, to raise or lower one end of the bottle. The configuration is quite similar to that of the Rodin device discussed further above, with no positive means for holding the bottle at a predetermined angle, as provided by the present bottle holder in its various embodiments.

U.S. Pat. No. 3,144,230 issued on Aug. 11, 1964 to Durward L. Brooks describes a Nursing Bottle Support, comprising an elongate connector formed of wire and having a pair of spaced apart loops formed therein. One end of a neck strap is secured to each loop, with an elastic strap extending from each loop to secure a bottle therein. As in the cases of the Rodin and Liebendorfer bottle holders discussed above, adjustment of the angle of the bottle is accomplished by repositioning the strap around the user's neck, rather than shifting the bottle within the holder, as is done in the case of the present bottle holder invention.

U.S. Pat. No. 3,197,099 issued on Jul. 27, 1965 to Inez Doba describes Nursing Bottle Holders formed of a coiled plastic strip configured to surround a baby bottle. The free end of the coil extends to form a larger loop, which serves to suspend the holder from the neck of the user. The fixed angle of the relatively rigid plastic material holds the bottle with the nipple downward, and no raising of the nipple end is provided.

U.S. Pat. No. 4,096,977 issued on Jun. 27, 1978 to George W. Barville et al. describes a Device For Anchoring Bottles Or The Like, And Method. The device comprises an open ended harness, which is securable about an infant by means of mating hook and loop fastening material at the ends of the straps. A removable attachment for a baby bottle is provided on the front of the harness, comprising a resilient ring which fits around the relatively narrow neck of a conventional baby bottle. Thus, the bottle would only be suspended by its neck, with the center of gravity of the bottle tilting the bottle to a nipple up position. The bottle would have to be actively tilted to and held in a nipple downward position for feeding, whereas the present holder automatically holds the bottle ar the desired angle. Moreover, the Barville et al. device is not adapted to suspend the bottle from the parent or guardian holding the child, as provided by the present holder.

Finally, U.S. Pat. No. 4,220,302 issued on Sep. 2, 1980 to Jarold L. Hampton et al. describes a Nursing Bottle Holder comprising a shoulder strap with a Velcro (tm) patch thereon. A sleeve securable about a bottle includes a patch of mating Velcro thereon, enabling the bottle to be secured to the strap at any desired angle. The bottle does not automatically hang at the proper angle due to the specific configuration of the bottle sleeve and neck strap, as provided by the present bottle holder.

None of the above inventions and patents, either singly or in combination, is seen to describe the instant invention as claimed.

SUMMARY OF THE INVENTION

The present invention comprises various embodiments of a baby bottle holder which enables a bottle contained therein to be positioned either with the nipple end downward, for feeding an infant, or with the nipple end upward when no feeding is occurring, to preclude leakage from the tip of the nipple. The holder includes a neck sling which secures removably about the neck of the parent or person feeding the infant, and sleeve means into which the bottle is placed. The sleeve means may comprise a fabric sleeve which secures loosely about the majority of the bottle, an elastic strap which secures tightly about a portion of the bottle, or some combination of the two.

In each embodiment, the holder is secured to the bottle by a single strap at the bottle nipple end of the holder, which strap includes mating portions of hook and loop fastener material disposed over a single surface thereof, so the strap may be passed through an opposite loop or ring and doubled back over itself to secure about the upper or nipple end of the bottle. The sleeve, and the attachment of the neck strap thereto, is configured to cause a bottle placed therein to hang with the nipple end downward, for the convenient and hands free feeding of an infant held in the arms of a user of the present holder. The bottle is easily repositioned with the nipple end upward to preclude leakage of fluid from the nipple tip, by everting the holder sleeve around the bottle, or sliding the elastic sleeve upwardly along the bottle so the center of gravity of the bottle is below the sleeve and neck strap.

Accordingly, it is a principal object of the invention to provide an improved baby bottle holder including a neck support sling removably securable about the neck of a person bottle feeding an infant, with sleeve means extending from the neck sling to surround a baby bottle at least partially therein, and with bottle securing means comprising a doubled over strap which secures to itself about the bottle adjacent to the nipple end thereof.

It is another object of the invention to provide an improved baby bottle holder which sleeve means comprises a wide sheet formed in a conical section to have a major and a minor diameter larger than a baby bottle, with a neck sling attachment portion rearwardly offset from the bottle securing means being securable about the bottle to cause the bottle to be tilted downwardly toward the nipple end thereof and providing for the eversion of the conical sheet to raise the nipple end of the bottle held therein without repositioning the neck strap on the user.

It is a further object of the invention to provide an improved baby bottle holder which sleeve means comprises an elastic band tightly securable about a baby bottle and connected to the forward bottle securing means by a flexible strap, to cause the bottle to be tilted downwardly until the sleeve means is slid upwardly along the bottle to cause the center of gravity of the bottle to be positioned beyond the sleeve means, thereby causing the bottle held therein to tilt upwardly without repositioning the neck strap on the user.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
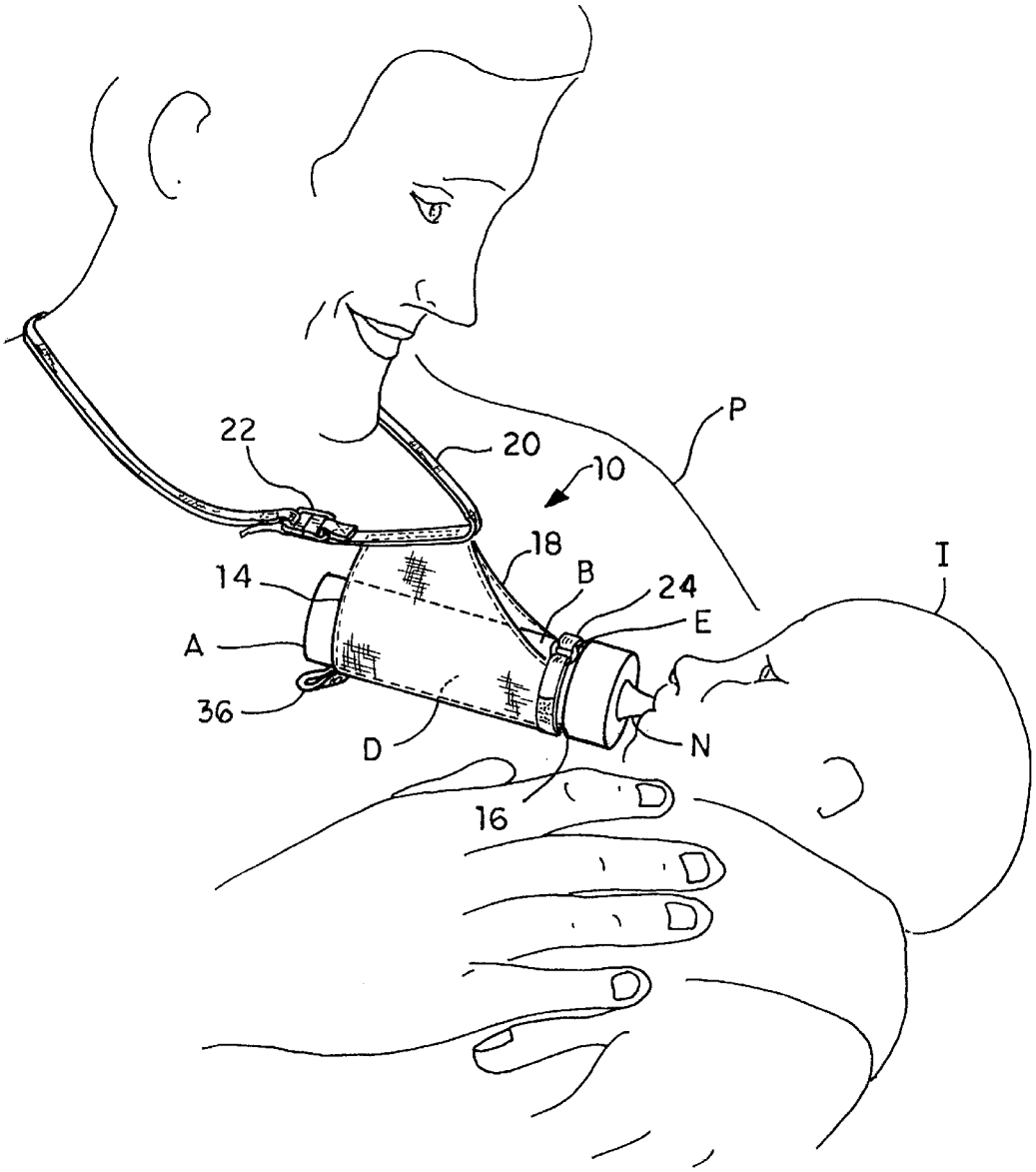
FIG. 1 is an environmental perspective view of a first embodiment of the present baby bottle holder in use, showing its general features and use.
Figure 2:
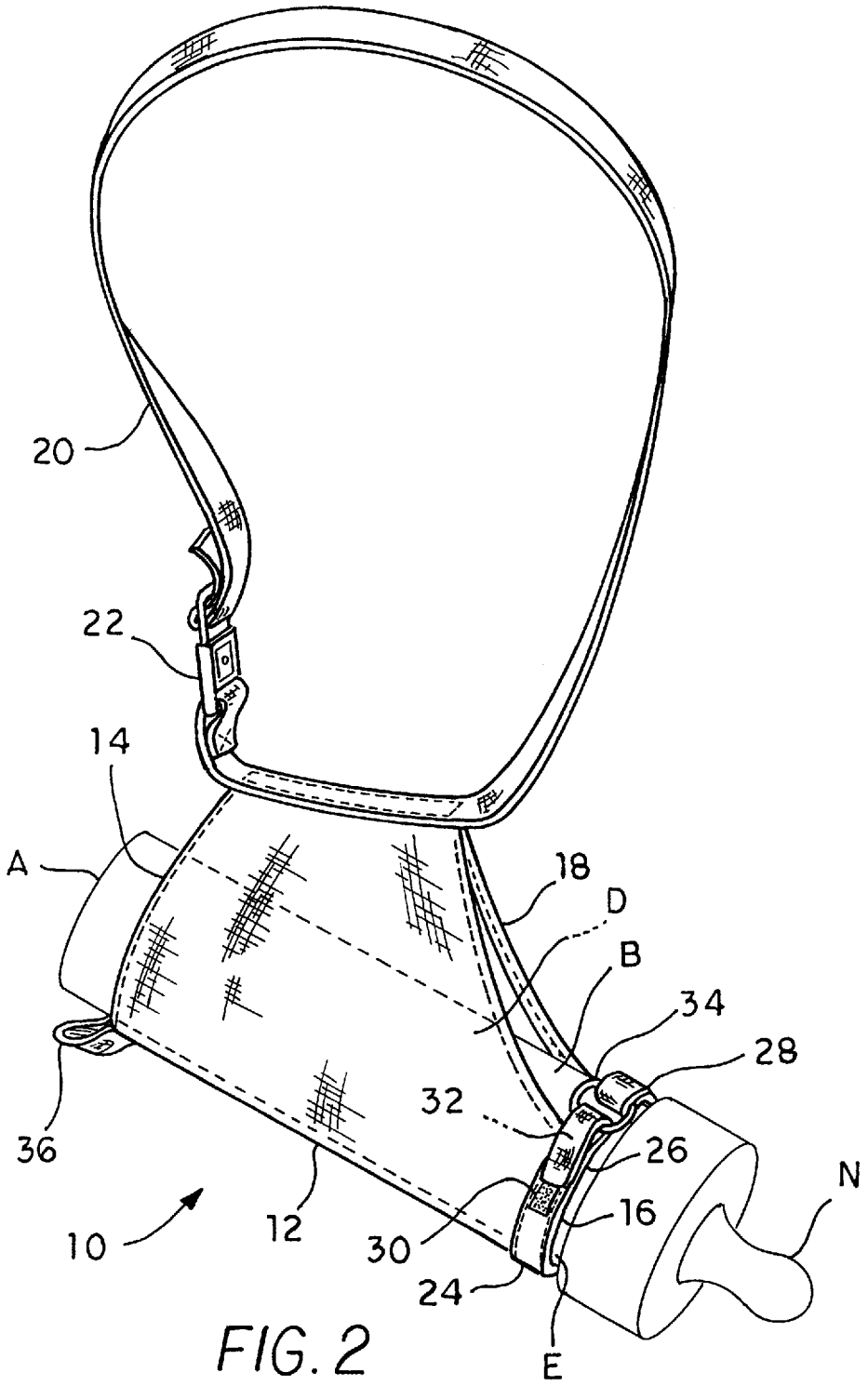
FIG. 2 is a perspective view of the holder of FIG. 1 with a baby bottle held therein, showing further details thereof.
Figure 3:
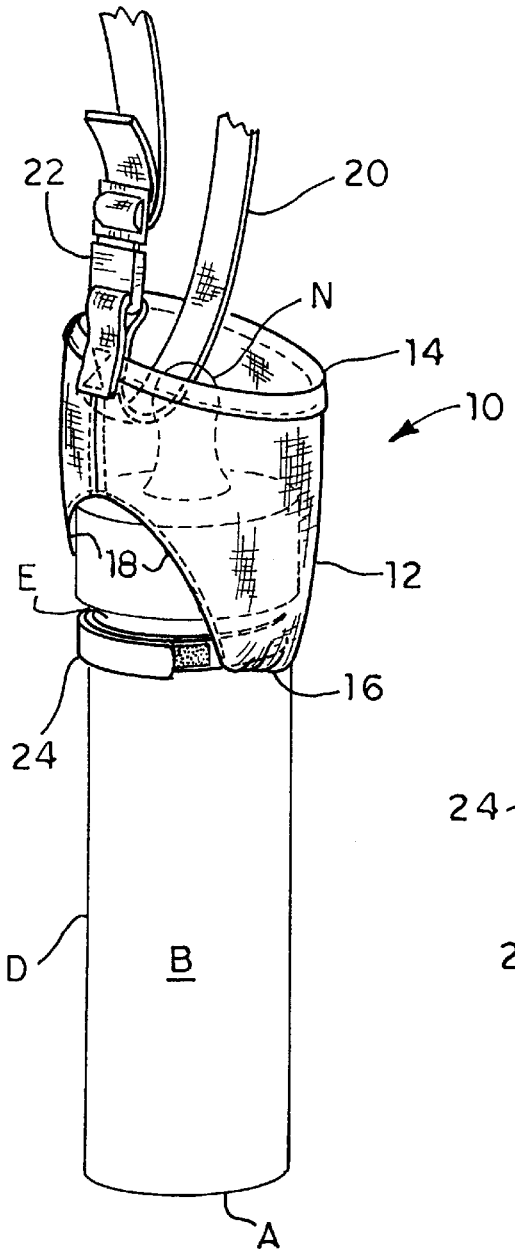
FIG. 3 is a perspective view of the holder of FIGS. 1 and 2, showing the sleeve thereof in an everted position to cause the bottle held therein to be positioned with the nipple end upward.

The present invention comprises various embodiments of a baby bottle holder, with a first embodiment shown in FIGS. 1 through 3 and designated generally by the reference numeral 10. The bottle holder 10 of FIGS. 1 through 3 allows a parent P or guardian or caretaker of a bottle fed infant I to administer a bottle B to the infant without need to hold the bottle manually, as shown in FIG. 1. The specific configurations of the various embodiments of the present baby bottle holder automatically angles the bottle B downwardly for feeding the infant, as shown in FIG. 1, while also allowing the bottle B to be held in a stored position with the nipple N disposed upwardly when not being used, as in FIG. 3.

The bottle holder 10 of FIGS. 1 through 3 includes a sleeve portion 12, which is formed of a pliable, flexible material such as a light but durable fabric, or other suitable thin sheet material. The sleeve 12 is formed to have the shape of a section of a cone, with the apex removed to provide a minor diameter end 14 which fits around the base A or body D of the bottle B. The opposite, major diameter end 16 includes a partially truncated portion 18, which is adapted to fit around the upper or neck end E of the bottle B. Both the bottle base or minor diameter end 14 and the bottle neck or major diameter end 16 of the bottle sleeve 12 have a larger diameter than that of the bottle B, in order that the bottle B may be easily inserted into and removed from the sleeve 12 as desired. The truncated portion 18 provides an even larger effective diameter for the major diameter end 16 of the sleeve 12.

An adjustable neck securing sling 20 is affixed (sewn, etc.) along one side of the sleeve 12, from the minor diameter end 14 to the major diameter end 16 thereof. The sling 20 includes an adjustable buckle, latch, or clasp 22, enabling the user of the present bottle holder 10 to adjust the length of the sling 20 to position a bottle B therein at the proper height relative to an infant I which may be held in the arms of the parent P, as shown in FIG. 1. As the bottle neck end 16 has a larger diameter than the opposite base end 14 of the sleeve 12, the suspension of the sleeve 12 from the neck sling 20 will cause the opposite, lower side of the sleeve 12 to slope downwardly, with the major diameter end 16 being generally lower than the minor diameter end 14 of the sleeve 12, due to the generally conical shape of the sleeve 12. Thus, a bottle B placed within the sleeve 12 with the neck end E and nipple N toward the larger diameter end 16 of the sleeve 12, will slope downwardly toward the nipple N of the bottle B, allowing the contents of the bottle B to flow naturally toward the nipple N.

The larger diameter bottle neck end 16 of the sleeve 12 must provide some means for securing the bottle B within the sleeve 12, to preclude its sliding downwardly and out of the larger diameter end 16 of the sling 12. Accordingly, an adjustable bottle neck securing strap 24 is provided at the major diameter end 16 of the sleeve 12, for securing about the neck end E of the bottle B. The strap 24 is affixed (sewn, etc.) to the end 16 of the sleeve 12, and opens across the truncated portion 18 of the major diameter end 16 of the sleeve 12.

Figure 4:
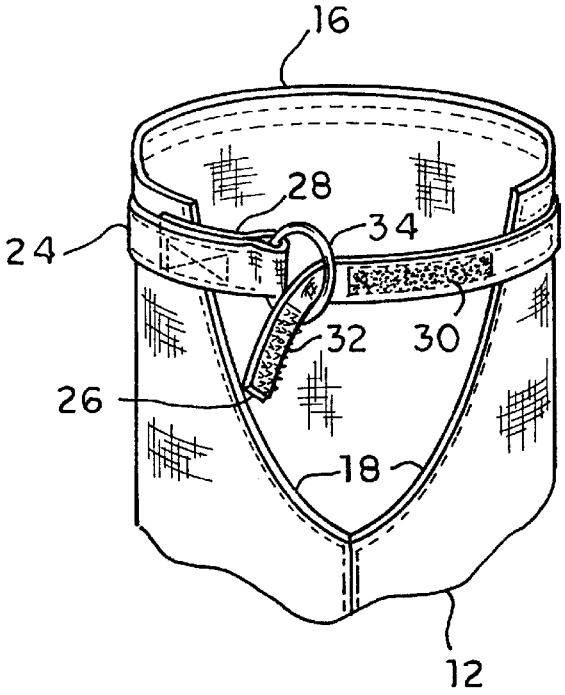
FIG. 4 is a detailed and fragmented perspective view of the present holder, showing details of the adjustable securing strap thereof which is adapted to secure removably about the neck of the bottle adjacent to the nipple end thereof.

The above described strap 24 is essentially identical for each of the embodiments of the present invention, and is shown in detail in FIG. 4. The strap 24 is affixed to the major diameter end 16 of the sleeve 12 generally across from the truncated portion 18 thereof, located in the upper portion of the sleeve 12 adjacent the attachment of the neck sling 20. Thus, as the strap 24 is secured about the neck E of a bottle B, it will tend to pull the neck end E and nipple N extending therefrom, downwardly to the lowermost portion of the major diameter end 16 of the sling 12. The opposite base end A of the bottle B is raised somewhat higher due to its being supported within the smaller diameter end 14 of the sling 12, which is in turn also supported by the neck sling 20.

The bottle securing strap 24 comprises a flat strip of flexible material with an extended first end 26 and opposite second end 28. The first end 26 has an outwardly facing surface with two different types of mating hook and loop fastening material (e. g., Velcro, tm) thereon, with the first portion of the end 26 having a first type 30 disposed thereon and the distal second portion 28 having a mating second type 32 disposed thereon. Thus, it will be seen that folding over the first end 26 of the strap 24 so the first and second portions 30 and 32 of the hook and loop fastener surface are in contact with one another, will cause the strap end 26 to secure to itself. The two hook and loop fastener portions 30 and 32 are easily separated by pulling apart to extend the first end 26 of the strap 24 as desired.

The opposite second end 28 of the strap 24 is permanently looped around a ring 34 (D-ring, O-ring, etc.), which extends therefrom. The strap 24 is secured about the neck end E of a bottle B by passing the distal end portion 32 of the extended first end 26 through the ring 34, and pulling it tightly about the neck end E of the bottle B and then doubling it back upon itself so the mating hook and loop fastener portions 30 and 32 secure to one another. This arrangement provides an exceptionally tight fit about the bottle B, precluding any slippage or relative movement thereof within the strap 24 and bottle neck end 16 of the sleeve to which the strap 24 is secured. Yet, the bottle B is easily removed by lifting and peeling the distal end portion 32 from its mating counterpart 30, and withdrawing the extended end portion 26 at least partially from the ring 34, to loosen the grip of the strap 24 and bottle neck end 16 of the sleeve about the bottle B.

The present bottle holder in each of its embodiments also provides an easy means of holding the bottle B in an upright or storage position, with the nipple N raised to preclude fluid spillage or flow therefrom. The embodiment of FIGS. 1 through 3 achieves this by everting the sleeve 12 about the upper end of the bottle B, as shown in FIG. 3. The bottle B is merely pulled back through the sleeve 12, with the bottle neck end 16 of the sleeve 12 being held firmly about the neck end E of the bottle B. Yet, the opposite minor diameter end 14 of the sleeve 12 is free to pass over the neck end E of the bottle B, due to its having a larger diameter than the bottle B.

The body D and center of gravity of the bottle B are thus disposed outside the sleeve 12, and hang below the sleeve 12 to position the neck and nipple end E of the bottle B, and the nipple N, within the everted sleeve 12. This not only positions the bottle B in a generally upright position to preclude leakage or spillage from the nipple N, but it will be seen that the nipple N is also somewhat protected in this position from contact with other articles which might affect the sanitation of the nipple N. A pull tab 36 (FIG. 1) extending from the minor diameter end 14 of the sleeve 12 may be provided to assist the user in everting and reverting the sleeve 12 about the bottle B.

Figure 6:
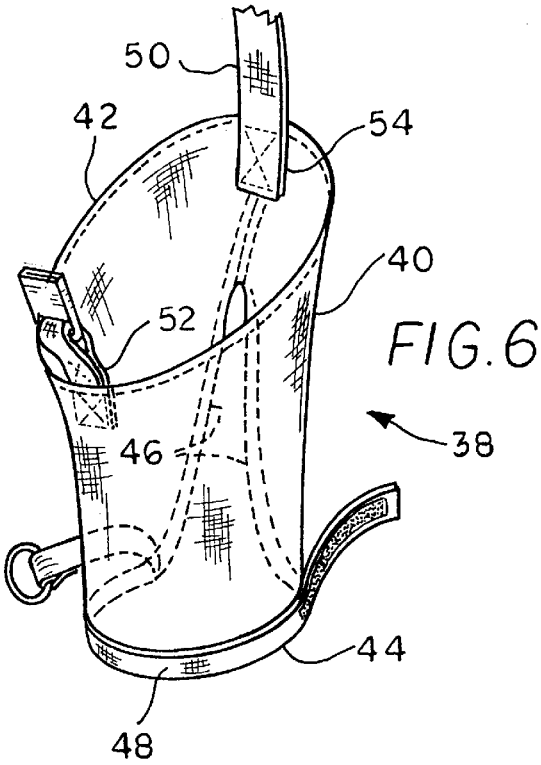
FIG. 6 is a detailed perspective view of the holder of FIG. 5, showing further details thereof.
Figure 7:
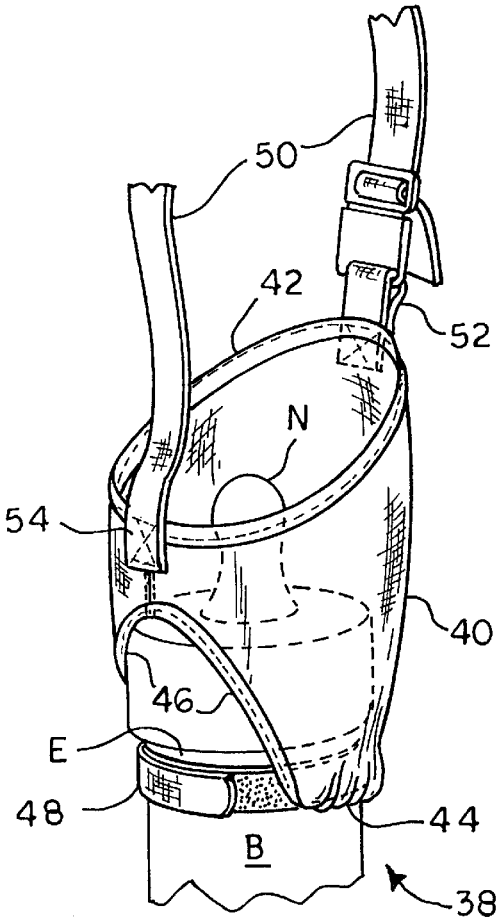
FIG. 7 is a perspective view of the holder of FIGS. 5 and 6, showing the sleeve thereof in an everted position to cause the bottle held therein to be positioned with the nipple end upward.
Figure 5:
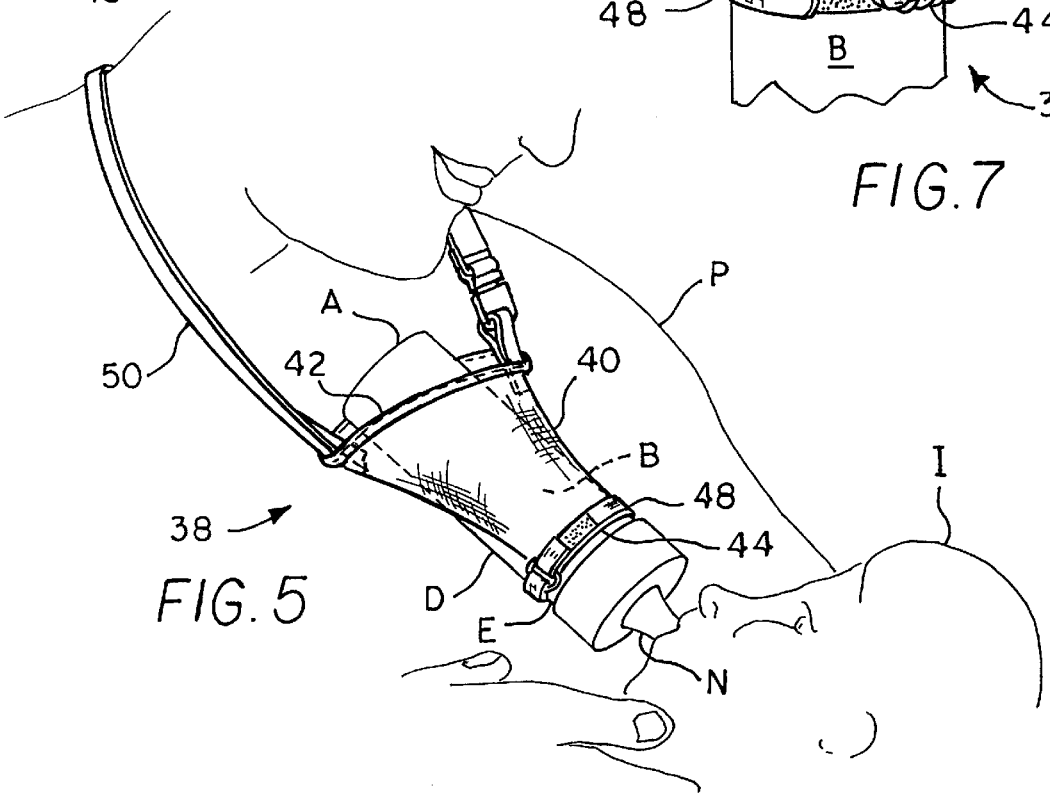
FIG. 5 is an environmental perspective view of a second embodiment of the present baby bottle holder in use.

FIGS. 5 through 7 disclose an alternate embodiment of the present baby bottle holder, generally designated by the reference numeral 38. The general configuration of a conical sleeve 40 having a minor diameter end 42, an opposite major diameter end 44 with a truncated portion 46, and a bottle neck securing strap 48, will be seen to be similar to the sleeve 12 with its major and minor diameter ends 14 and 16, truncated portion 18, and bottle neck strap 24 of FIGS. 1 through 3. However, the bottle holder 38 of FIGS. 5 through 7 includes a different neck support sling arrangement, wherein the sling 50 has a first end 52 and an opposite second end 54, each affixed (sewn, etc.) to the minor diameter bottle end 42 of the sleeve 40 on diametrically opposite sides thereof.

This configuration allows a bottle B to be placed within the bottle holder 38 with the neck end E of the bottle B secured by the strap 48, as shown in FIG. 5 and similarly to the arrangement shown in FIG. 1 with the bottle holder 10. However, the sleeve 40 of the bottle holder 38 of FIGS. 5 through 7 is held upwardly around the body D of the bottle B to provide support therearound, due to the supporting sling 50 extending only from the minor diameter or bottle base end 42 to provide all support from that end. Eversion of the sleeve 40 about the upper or neck end E of the bottle B, as shown in FIG. 7, causes the main body D and center of gravity of the bottle B to be positioned beyond the sleeve 40, thus drawing the sleeve 40 upwardly about the neck end E and nipple N of the bottle B, similarly to the arrangement shown for the bottle holder embodiment 10 of FIG. 3.

Figure 8:
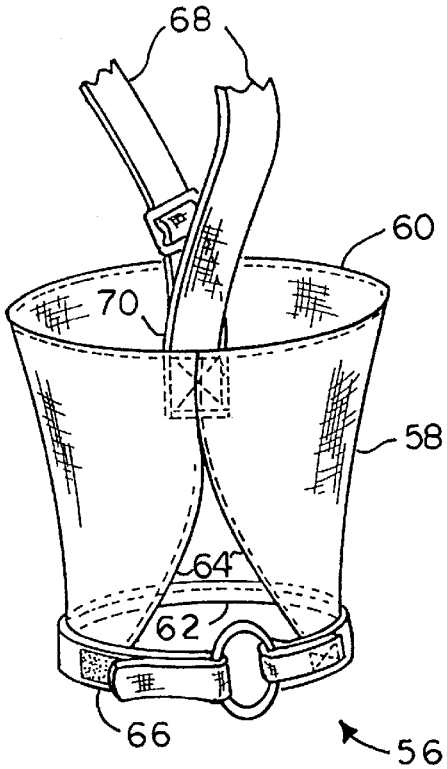
FIG. 8 is a perspective view of a further embodiment of the holder of FIGS. 5 through 7, showing the attachment of the neck strap to only a single side thereof.

FIG. 8 discloses a further embodiment of the present baby bottle holder, generally designated by the reference numeral 56. This embodiment is generally similar to the embodiment of FIGS. 5 through 7, with a conical sleeve 58 having a minor diameter end 60, an opposite major diameter end 62 with a truncated portion 64, and a bottle neck securing strap 66. The neck support sling arrangement of this bottle holder 56 differs from that of the holder 38 of FIGS. 5 through 7, in that the sling 68 has both ends 70 sewn or otherwise affixed to a single point on the minor diameter end 60 of the sleeve 58, preferably along the bisector of the truncated portion 64. The operation of the bottle holder 56 of FIG. 8 is similar to that of holder 38 of FIGS. 5 through 7.

Figure 9:
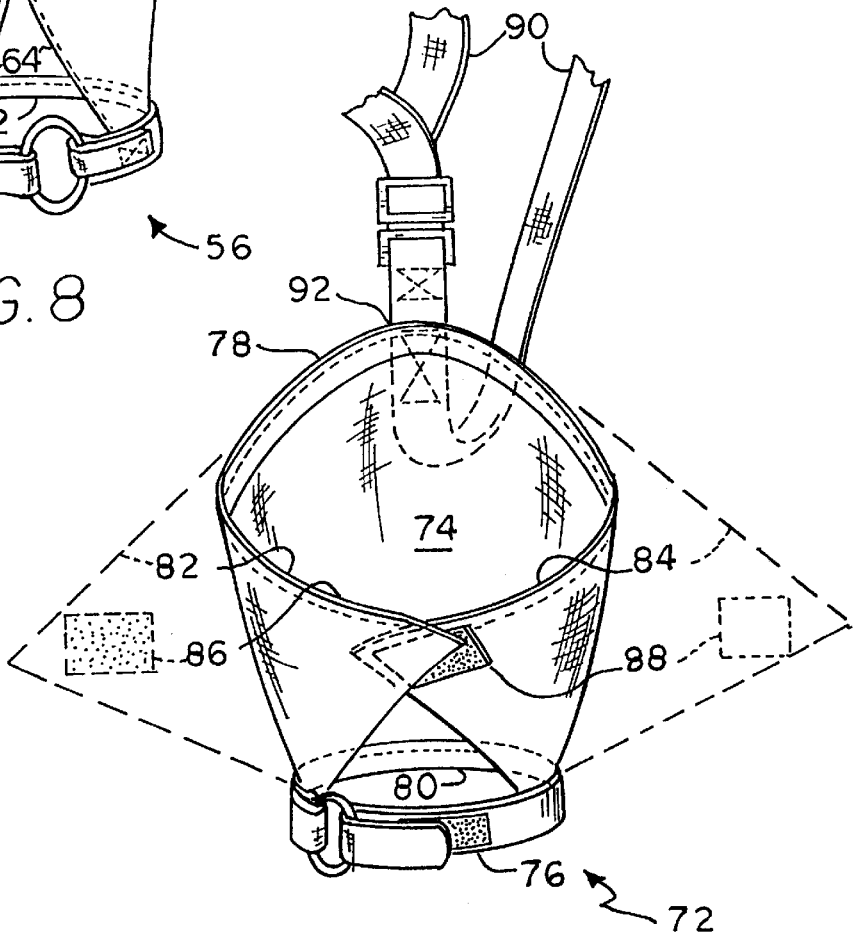
FIG. 9 is a perspective view of a further embodiment of the holder of FIG. 8, showing an openable sleeve.

FIG. 9 discloses a further embodiment wherein a relatively wide sleeve is used to surround and hold the bottle, generally designated by the reference numeral 72. In this embodiment, the sleeve 74 is not permanently closed, but forms a flat sheet in its open configuration. The sleeve 74 may be selectively opened along with the bottle neck securing strap 76, similarly to the straps 24, 48, and 66 discussed above in the other embodiments described thus far. The sleeve 74 includes a minor diameter end 78 and an opposite major diameter end 80 to which the bottle neck securing strap 76 is affixed, but also has opposite, selectively openable mating first and second edges 82 and 84, which may be secured together around a bottle as desired by means of mating first and second portions 86 and 88 of hook and loop fastening material, or other suitable means as desired.

A neck supporting sling 90 is secured to a single point along the minor diameter end 78, generally opposite the connecting first and second edges 82 and 84, in the manner of the support sling 68 of the embodiment of FIG. 8. However, the bottle holder embodiment 72 of FIG. 9 forms the truncated portion of the sleeve major diameter end 80 above the bottle neck securing strap 76, by securing the two apices or ends 82 and 84 of the sleeve 74 together. Thus, the single attachment point 92 of the sling 90 cannot be located adjacent the truncated portion of the sleeve, as in the permanently formed sleeve 58 of the bottle holder 56 of FIG. 8.

The bottle holder 72 of FIG. 9 is used by wrapping the sleeve portion 74 about the bottle and temporarily securing the two mating hook and loop fastener portions 86 and 88 together to close the sleeve 74. The bottle neck securing strap 76 is secured about the neck of the bottle, as described further above in other embodiments of the present invention. The sling 90 is placed about the neck of the parent or person caring for the infant, and the length is adjusted as required. The bottle holder 72 of FIG. 9 is then used in a manner similar to that described above for other embodiments, with the bottle being suspended with the nipple downward due to the body or the bottle being supported by the sleeve 74 wrapped thereabout eversion of the sleeve over the nipple end of the bottle allows the bottle to be supported in an upright position in the holder 72, with the nipple raised to preclude leakage therefrom in a disposition similar to that shown for the bottle holders 10 and 38 respectively of FIGS. 3 and 7.

Figure 10:
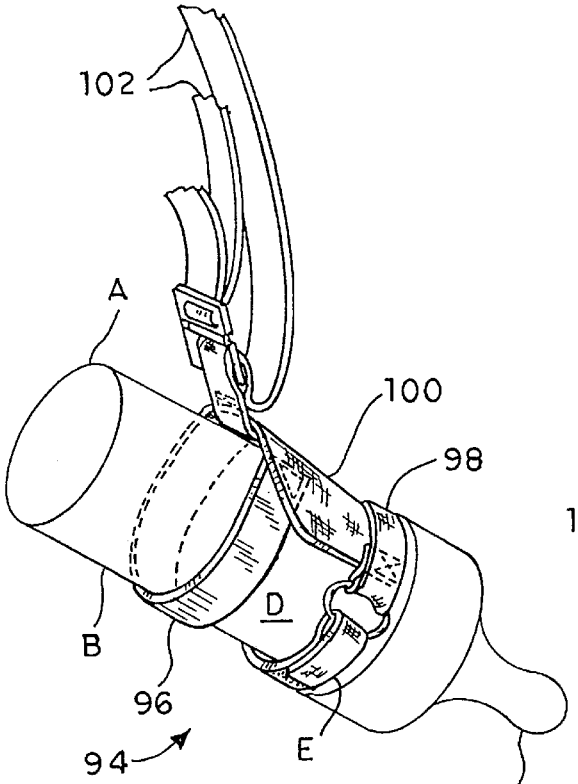
FIG. 10 is a perspective view of another embodiment of the present bottle holder, wherein the sleeve means comprises an elastic sleeve separated from the securing strap by a pliable sheet of material.
Figure 11:
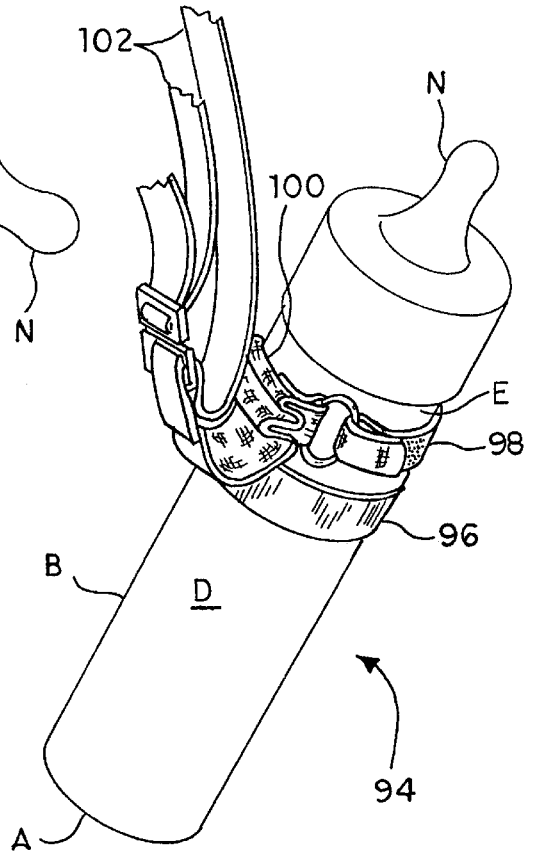
FIG. 11 is a perspective view of the bottle holder of FIG. 10, showing the elastic sleeve moved toward the nipple end of the bottle to position the center of gravity of the bottle beyond the holder, thereby tipping the nipple end of the bottle upward.

FIGS. 10 and 11 disclose a further embodiment of the present bottle holder, designated as holder 94 in the drawings. Rather than having a relatively loose sleeve of conical section which supports the bottle in an inverted or nipple downward position for feeding, and is eversible to hold the bottle in an upright position for storage, the bottle holder 94 of FIGS. 10 and 11 utilizes an elastic band sleeve 96 which stretches about the circumference of the body D of the bottle B. The band 96 sleeve is connected to a bottle neck securing strap 98 by a connecting member comprising a partial sleeve portion 100 between the band 96 and strap 98.

The bottle holder 94 is used by stretching the elastic band sleeve member 96 to fit adjustably about a baby bottle B, and passing it over either the base A or the neck end E and nipple N of the bottle, as desired, to secure about the body D of the bottle, as shown in FIG. 10. The bottle neck securing strap 98 will be seen to have a configuration essentially the same as the strap 24 disclosed in detail in FIG. 4 of the drawings, and used with each of the embodiments of the present invention. The strap 98 is secured tightly about the neck end E of the bottle B, in a manner essentially the same as that discussed further above for the embodiments of FIGS. 1 through 9.

The connecting member or partial sleeve 100 which extends between the elastic band sleeve member 96 and the bottle neck securing strap 98, is sufficiently long to allow the elastic band 96 to be placed well down the body D of the bottle B, so the center of gravity of the bottle B is positioned between the elastic band or sleeve 96 and the bottle neck securing strap 98. An adjustable neck suspension sling 102 extends from the elastic band or sleeve 96 and its attachment with the partial sleeve portion 100 which serves as a connecting member between the elastic sleeve 96 and the bottle neck securing strap 98. Thus, a bottle B suspended within the holder 94, will tilt downwardly with the nipple N below the body D of the bottle B, as shown in FIG. 10.

For temporary storage of the bottle B when the infant is not feeding, the bottle B may be positioned with the nipple N raised, merely by repositioning the center of gravity of the bottle B beyond the elastic band 96, by sliding the band 96 toward the bottle neck strap 98 to gather the flexible and pliable sleeve portion 100 between the elastic band or sleeve 96 and the bottle neck strap 98, as shown in FIG. 11. This principle of positioning the center of gravity of the bottle B beyond the sleeve portion of the bottle holder, either by everting the sleeve around the uppermost portion of the bottle, as in the embodiments of FIGS. 1 through 9, or sliding the sleeve toward the bottle neck, as in the embodiments of FIGS. 10 through 13, is universal for all embodiments of the present bottle holder.

Figure 12:
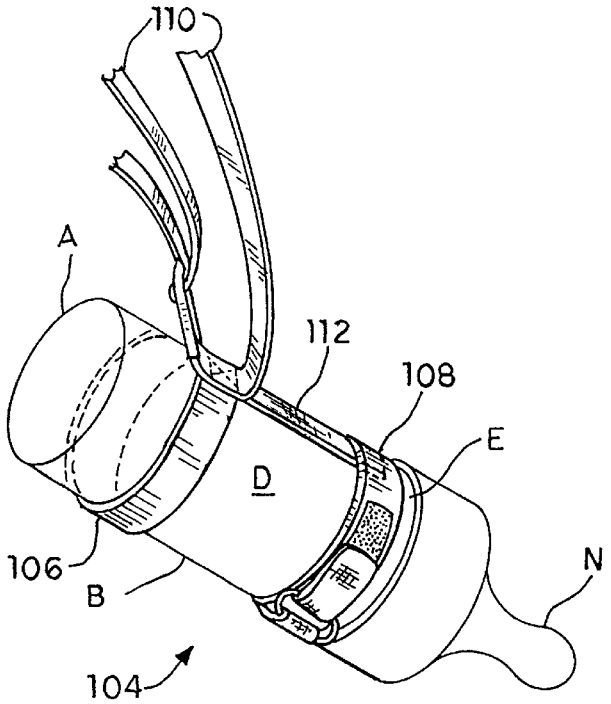
FIG. 12 is a perspective view of yet another embodiment of the present bottle holder, with the sleeve means comprising an elastic sleeve separated from the securing strap by a pliable strap.
Figure 13:
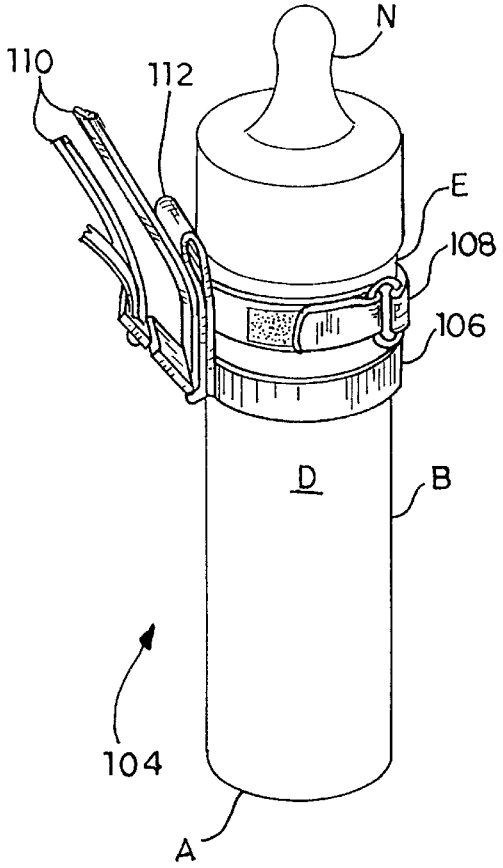
FIG. 13 is a perspective view of the bottle holder of FIG. 12, showing the elastic sleeve moved toward the nipple end of the bottle to position the center of gravity of the bottle beyond the holder, thereby tipping the nipple end of the bottle upward.

Yet another embodiment of the present baby bottle holder is disclosed in FIGS. 12 and 13, and is designated as bottle holder 104 in those figures. The bottle holder 104 of FIGS. 12 and 13 will be seen to be similar to the holder 94 of FIGS. 10 and 11, having an elastic band sleeve member 106 which is adjustably stretched about the circumference of the bottle B, below the center of gravity of the bottle B (generally indicated by the location of the reference character D, for the body of the bottle B). A bottle neck securing strap 108 is secured about the neck end E of the bottle B, in a manner similar to that described above for the other embodiments. A neck supporting sling 110 extends from the elastic sleeve band 106, similar to the supporting sling 102 of the bottle holder embodiment 94 of FIGS. 10 and 11.

However, rather than having a portion of a sleeve member connecting the band 106 to the bottle neck securing strap 108 and extending therebetween, the bottle holder 104 of FIGS. 12 and 13 uses a flexible and pliable longitudinal strap 112. The operation of the bottle holder 104 is similar to that of the holder 94 of FIGS. 10 and 11, with the strap 112 being of sufficient length to allow the elastic sleeve band 106 to be positioned below the center of the body D of the bottle B, so the neck end E and nipple N of the bottle B will hang downwardly therefrom for feeding an infant. Yet, the bottle holder 104 provides a storage position for the bottle B with the nipple N raised, as shown in FIG. 11, by moving the elastic sleeve 106 above the center of gravity of the bottle B, so the center of the bottle B (generally indicated by the reference character D in FIGS. 10 and 11) is positioned below the elastic sleeve band 106. Thus, the elastic band 106 is positioned adjacent the bottle neck securing strap 108, with the longitudinal connecting strap 112 extending between the elastic sleeve 106 and the neck securing strap 108 being gathered, as shown in FIG. 13.

In summary, the various embodiments of the present baby bottle holder all provide a most convenient hands free means of bottle feeding an infant. The various embodiments of the present bottle holder automatically suspend the bottle with the nipple end down, thereby delivering liquid to the infant and precluding the ingestion of air by the infant to reduce colic and the need for burping the infant. The bottle holder embodiments are generally symmetrical, and may be placed to face either to the left or right.

Yet, the present bottle holder embodiments also provide a convenient means of suspending the bottle with the nipple end upright for temporary storage, to preclude dripping, leakage, or spillage from the nipple end when the bottle is not in use. This is accomplished by shifting the center of gravity of the bottle relative to the sleeve portion of the bottle holder, so the center of gravity is below the sleeve portion of the holder. In several embodiments, this is accomplished by everting a relatively loose fitting sleeve member about the bottle, so the everted sleeve extends around the nipple end of the bottle to enclose and protect the nipple partially. In other embodiments, the sleeve comprises a close fitting elastic band, which is moved upwardly along the body of the bottle to a position adjacent the bottle neck securing strap and above the center of gravity of the bottle, to cause the main body of the bottle to hang beneath the holder with the nipple end upward.

The present bottle holder in any of its embodiments may be formed of any suitable flexible and pliable and/or elastic materials, depending upon the specific embodiment and component. Brightly colored contrasting synthetic fabric materials and patterns have been found to be particularly suitable, as it has been found that infants are more attracted to and visually stimulated by such bright colors and contrasting patterns and materials. In any event, the present baby bottle holder embodiments will serve as a most useful accessory for parents and others who have need to bottle feed an infant at any time.

It is to be understood that the present invention is not limited to the sole embodiments described above, but encompasses any and all embodiments within the scope of the following claims.

I claim:

1. A baby bottle holder for holding a baby bottle having a body with a base and an opposite neck, and a nipple extending from the neck, said bottle holder comprising:

an elastic band for stretchably securing about the body of a baby bottle;

a bottle neck securing strap being adjustable for removably and tightly securing about the neck of the bottle;

a pliable and flexible connecting member extending from said elastic band to said bottle neck securing strap, wherein said connecting member comprises a longitudinal strap;

an adjustable neck suspension sling extending from said elastic band for suspending said band from the neck of an adult; whereby said holder is configured for supporting the bottle in a feeding position with the bottle neck and nipple disposed lower than the base with said band and said bottle neck securing strap separated along the bottle thereby extending said connecting member and in a storage position with the bottle neck and nipple disposed higher than the base with said band repositioned toward said bottle neck securing strap.

2. The baby bottle holder according to claim 1, wherein said bottle neck securing strap comprises a flat strip of flexible material having an extended first end with one surface having a first portion with first hook and loop fastening material disposed thereon and a distal second portion having mating second hook and loop fastening material disposed thereon, and a second end having an attachment ring extending therefrom for passing said first end therethrough and doubling over said first end about said attachment ring so that said first and said second hook and loop fastening material are removably secured together for securing said bottle neck securing strap tightly about the neck of the bottle.

* * * * *